United States Patent [19]

Hazard

[11] 4,219,138

[45] Aug. 26, 1980

[54] DISPENSING CLOSURE UTILIZING A SEALING ELEMENT SUPPORTED BY A WASHER SPRING

[75] Inventor: Robert E. Hazard, Kingstown, R.I.

[73] Assignee: Polytop Corporation, Slatersville, R.I.

[21] Appl. No.: 951,564

[22] Filed: Oct. 16, 1978

[51] Int. Cl.[2] ..... B67B 7/12

[52] U.S. Cl. ..... 222/534

[58] Field of Search ..... 222/556, 533, 534, 536; 251/172

[56] References Cited

U.S. PATENT DOCUMENTS

| | | | |
|---|---|---|---|
| 2,793,795 | 5/1957 | Wilson et al. | 222/536 |
| 2,800,259 | 7/1957 | Wilson et al. | 222/534 |
| 3,023,939 | 3/1962 | Gustafson | 222/536 |
| 3,477,618 | 11/1969 | Hazard | 222/534 |
| 3,653,546 | 4/1972 | Hazard | 222/534 X |
| 3,827,671 | 8/1974 | Bolden et al. | 251/172 X |
| 4,073,473 | 2/1978 | Rihm | 251/172 X |

*Primary Examiner*—Stanley H. Tollberg

*Attorney, Agent, or Firm*—Edward D. O'Brian; K. H. Boswell

[57] ABSTRACT

A dispensing closure can be constructed utilizing a washer spring around an opening through the cap of such a closure so as to resiliently bias a sealing surface carried by the washer spring against the spout of such a closure.

6 Claims, 6 Drawing Figures

DISPENSING CLOSURE UTILIZING A SEALING ELEMENT SUPPORTED BY A WASHER SPRING

BACKGROUND OF THE INVENTION

The invention set forth in this specification relates to new and improved dispensing closures. More specifically, it relates to the construction of such closures so as to minimize the chances of such closures leaking.

At the present time the term "dispensing closures" is commonly used to designate closures which are constructed so as to include a cap or a part of a container in effect serving as a cap, and a spout movably mounted upon such a cap or related part so as to be capable of being moved between open and closed positions. In such a closed position a portion of the spout normally referred to as the base of the spout fits with respect to the opening so that the opening is sealed off against leakage. In such an open position a passage through the spout is aligned with the opening.

Such dispensing closures are commonly manufactured in significant quantities using parts formed of various polyolefin polymers such as various injection moldable grades of polyethylene, polypropylene or out of various polymers that are closely related to these specific polymers. Dispensing closures manufactured out of such materials are normally constructed so as to utilize a sealing element or sealing means located around the cap or cap-like part of such a closure in order to prevent or minimize leakage between the spout and such a cap or cap-like part. Since virtually the advent of dispensing closures formed of materials as noted such leakage has been a significant problem to the industry. It would be possible to encumber this specification with a prolonged, detailed discussion as to various different specific structures which have been developed at various times and which have been effective to an increasingly greater degree in combatting leakage between a cap and a spout in a dispensing closure.

This problem of leakage in dispensing closures using parts manufactured from polyolefins and related materials is considered to be comparatively complex and to have many different facets. It is now considered to be well established that different types of fluids have different propensities towards leakage in such closures. Such leakage is most commonly minimized by holding the spout in a dispensing closure against a somewhat resilient, flexible sealing ring located around the opening through the cap of such a closure with sufficient force so that such force in combination with the inherent flexibility of the sealing ring will form an effective seal against leakage of most fluids.

The fact that seals as described in a general manner in the preceding discussion are reasonably effective in dispensing closures is amply evidenced by the fact that millions of such closures are manufactured and utilized every month on a wide variety of diverse products. However, it is considered that there still exists a need for improvement in the construction of dispensing closures so as to further reduce or minimize the possibility of such closures leaking. It is considered that this need is especially important in connection with the use of dispensing closures with various fluids which for one reason or another at times leak past the sealing structures as they are employed in presently existing dispensing closures.

SUMMARY OF THE INVENTION

A broad object of the present invention is to provide new and improved dispensing closures. A related object of the invention is to provide dispensing closures which are constructed so as to minimize the chances of such closures leaking. Further objectives of the invention are to provide dispensing closures as noted which can be easily and conveniently manufactured at a comparatively nominal cost which is substantially the same as the cost of manufacturing various known and commonly utilized dispensing closures. A further objective of the invention is to provide dispensing closures as noted which are especially significant in that they can be satisfactorily manufactured using parts of various polymers such as polypropylene which are of somewhat limited flexibility.

In accordance with this invention a dispensing closure having a cap is provided with an opening leading through the cap between the interior and the exterior of the cap, a sealing means for forming a seal with a spout located on the exterior of the cap around and adjacent to the opening and mounting means for holding a spout so that it can be moved relative to the cap, the dispensing closure also having a spout provided with a base and a passage extending through the spout from the base, the spout being held by the mounting means so as to be movable between a closed position in which the sealing means engages the base and seals off the opening and an open position in which the opening is aligned with the passage and in which the sealing means engages the base around the passage in which the improvement comprises: the cap including a resilient, spring-like member supporting the sealing means and extending outwardly therefrom so as to have a periphery spaced from the sealing means, the periphery being attached to and supported by the remainder of the cap, the spring-like member holding the sealing means resiliently against the base of the spout at all times during the movement of the spout between the open and closed position and when the spout is in these positions.

BRIEF DESCRIPTION OF THE DRAWING

The invention is best more fully explained with reference to the accompanying drawing in which.

Figure 1:
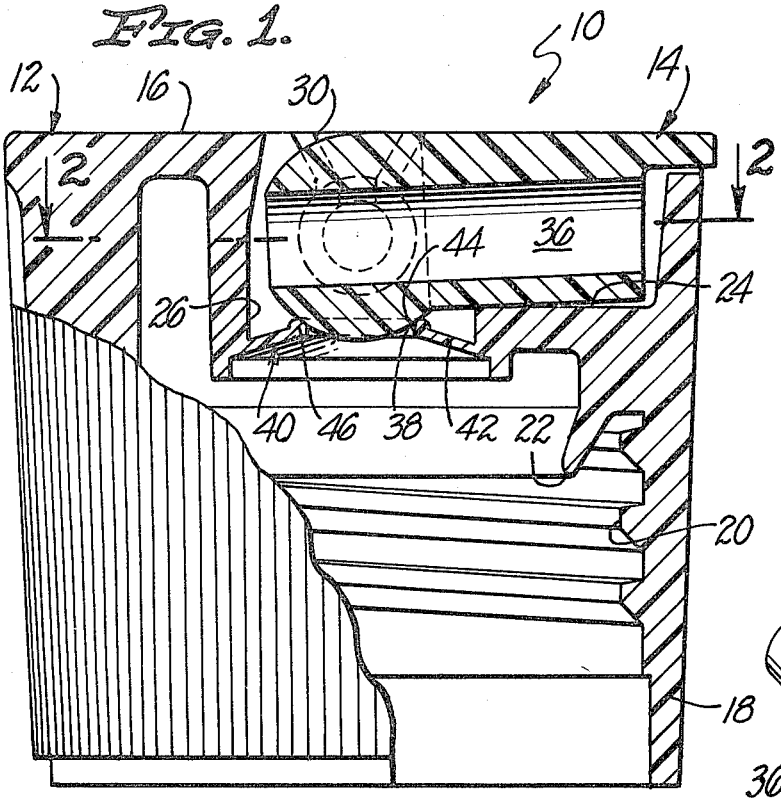
FIG. 1 is an enlarged side-elevational view, partially in section, of a presently preferred embodiment or form of a dispensing closure in accordance with this invention.

It is believed that it will be realized from the preceding discussion that the invention set forth in this specification involves certain structural concepts. These are set forth and defined in the appended claims. They are also utilized in the precise structure illustrated in the drawing. Those skilled in the art of designing dispensing closures will realize that these concepts can be utilized in other somewhat differently constructed and/or somewhat differently appearing dispensing closures through the use or exercise of routine engineering skill in the dispensing closure field.

DETAILED DESCRIPTION

In the drawing there is shown a dispensing closure 10 which is constructed so as to utilize a cap or cap part 12 and a spout 14. Both this cap 12 and the spout 14 may be conveniently formed by known injection molding techniques out of various injection moldable grades of polyethylene, polypropylene and various other polymers which are similar to such polymers in physical characteristics. It is considered particularly significant that the cap 12 employed in the closure 10 may be conveniently formed out of a polymer such as polypropylene which is relatively "difficult" to utilize in a conventional or known type of dispensing closure because such a polymer is not as resilient and flexible as non-linear polyethylene. If desired, the cap 12 may be formed integrally with or as a part of a container (not shown) such as a tube.

The particular cap 12 employed is of a type commonly utilized on a threaded bottle neck (not shown). This cap 12 includes a top 16 which is integral with a peripheral skirt 18 provided with internal threads 20. A conventional sealing flange 22 may depend from the remainder of the cap 12 immediately above the threads 20. The particular cap 12 employed also has an internal elongated cavity or slot 24 having an enlarged end 26. Known type "pop-in" bearing openings 28 are provided in the top 16 so as to open into the enlarged end 26. These bearing openings 28 have aligned axes (not shown) and are provided with tapered, slot-type entrances 30 so that aligned trunnions 32 on the base 34 of the spout 14 may be forced downwardly into and through these entrances 30 so as to be "popped" in place in the bearing openings 28. Preferably both the trunnions 32 and the bearing openings 28 are shaped as frustrums of right circular cones for reasons which are unrelated to the present invention. It is considered obvious that other known types of structures can be utilized in rotatably mounting the spout 14 upon the cap 12.

Figure 2:
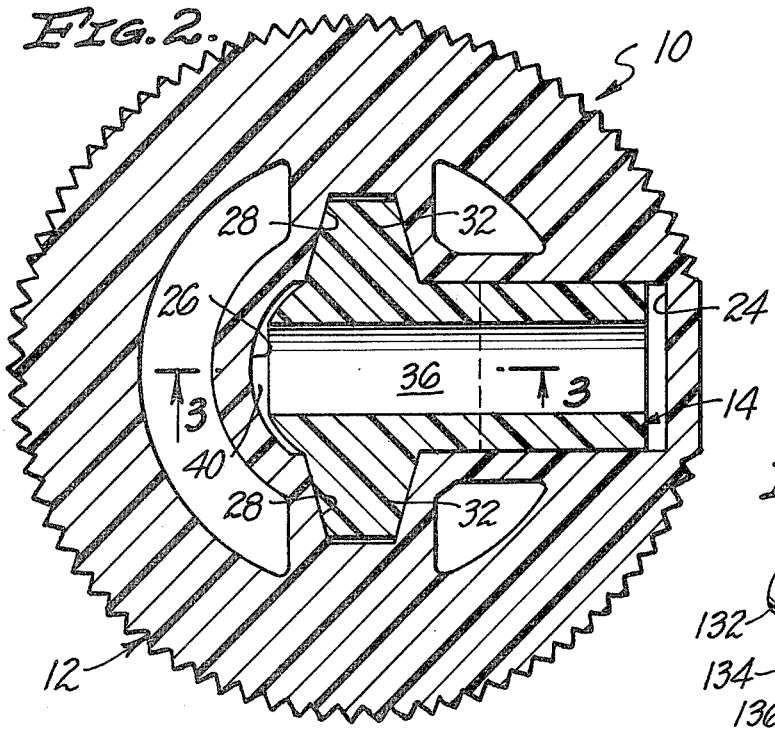
FIG. 2 is a cross-sectional view taken at line 2—2 of FIG. 1.

When the spout 14 is rotatably mounted upon the cap 12 the base 34 fits within the end 26. The remainder of the spout 14 extends within the length of the cavity 24 when the spout 14 is in a closed position as indicated in FIGS. 1 and 2 of the drawing. In such a closed position a passage 36 extending completely through the base 34 and the remainder of the spout 14 extends substantially horizontally and is spaced from an opening 38 leading from the interior (not spearately numbered) to the exterior (not separately numbered) of the cap 12. In this connection it is noted that the interior of the end 26 and the cavity 24 is regarded as forming a part of the exterior of the cap 12. In an open position of the spout 12 it extends vertically so that the passage 36 is aligned with the opening 38.

In a conventional dispensing closure an opening corresponding to the opening 38 is located in a comparatively rigid wall which is not intended to flex or move any noticeable or appreciable extent as such a closure is assembled or used. The present invention requires that the opening 38 be located centrally of a resilient washer spring 40 having a periphery 42 which is attached to and forms a part of the top 16 of the cap 12. This periphery 42 is supported by the top 16 in the closure 10 so that it is substantially incapable of movement during the assembly and use of the closure 10.

This washer spring 40 is sufficiently thin so as to be capable of flexing during such assembly and use of the closure 10 and is of such dimensions that a sealing surface 44 on the spring 40 extending immediately around and adjacent to the opening 38 resiliently bears against the base 34 at all times after the closure 10 is assembled. Although the sealing surface 44 may merely be a surface of the spring 40 defining the opening 38, it is preferred that this sealing surface 44 form a part of a slight enlargement 46 in the nature of an annular bead or ring extending around the opening 38. If desired the sealing surface 44 or such an enlargement 46 may be referred to as a sealing element or sealing means.

When such an enlargement 46 is used it is possible to vary the cross-sectional configuration of such an enlargement to a considerable extent. Thus, the enlargement 46 can be shaped so as to have an exposed surface resembling the cross-sectional configuration of a common, elastomeric "O" ring as shown. Such an enlargement 46 may also be constructed so as to have an upwardly extending V-shaped cross-sectional configuration corresponding to the configuration of flexible sealing rings which are commonly utilized in many known dispensing closures in order to tend to flex to a degree in forming a seal with the base 34 of the spout 14.

Figure 3:
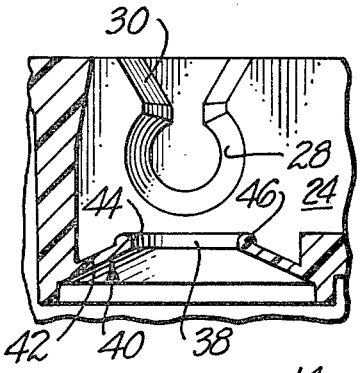
FIG. 3 is a partial cross-sectional view of a part of the cap employed in the closure illustrated in the preceding figures, this figure corresponding to a cross-sectional view taken at line 3—3 of FIG. 2 with the spout removed.
Figure 4:
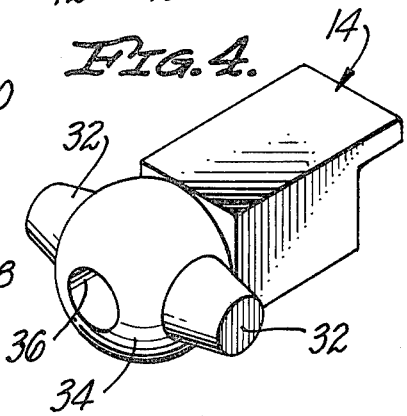
FIG. 4 is an isometric view of the spout employed in the closure illustrated in FIGS. 1 and 2.

In the particular closure 10 illustrated this base 34 is constructed so as to have a spherical configuration as illustrated in FIG. 4 of the drawing. When the base 34 is constructed in this manner it is preferred to locate the sealing surface 44 so that it extends essentially in a flat plane (not separately identified) as will be apparent from FIG. 3 of the drawing so as to obtain a substantially uniform sealing pressure along the length of the surface 44.

Figure 5:
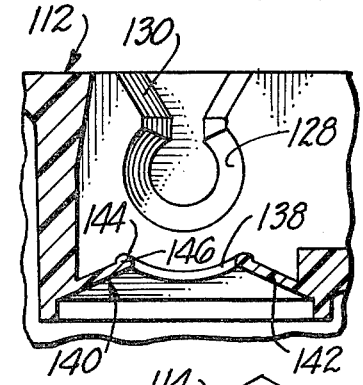
FIG. 5 is a view corresponding to FIG. 3 of a cap or a cap part of a modified form of a dispensing closure in accordance with this invention.
Figure 6:
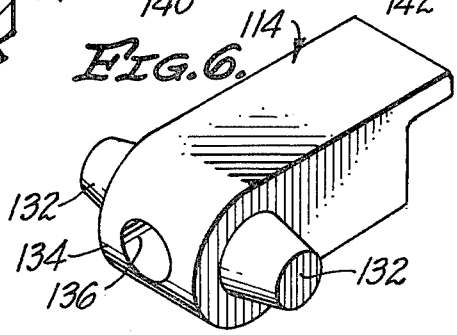
FIG. 6 is an isometric view of the spout employed with the cap or cap part illustrated in FIG. 5.

In FIG. 5 of the drawing there is shown a cap or cap part 112 of a modified dispensing closure in accordance with this invention. In FIG. 6 there is shown a spout 114 which is utilized with the cap or cap part 112 in such a modified dispensing closure. Because such a modified dispensing closure is closely related to the previously described dispensing closure 10 it is not considered necessary to illustrate the cap part 112 and the spout 114 assembled together so as to form a complete modified dispensing closure. Because of the close relationship of the cap 112 and the spout 114 with the cap part 12 and the spout 14 previously described all features or aspects of the cap part 112 and the spout 114 are not separately described herein. Instead, as an aid to brevity those parts of the cap part 112 and the spout 114 are designated in the remainder of this specification and in the drawing by the numerals previously utilized to designate such parts preceded by the numeral "1".

From a study of FIGS. 5 and 6 of the drawing it will be apparent that the cap part 112 differs from the cap part 12 in one essential regard: the resilient washer spring 140 differs from the washer spring 40 in that it is not shaped exactly as a uniform surface of revolution. Instead the spring 140 can be referred to as having a modified or somewhat distorted concavo-convex configuration or conical shape such that the sealing surface 144 extending immediately around and adjacent to the opening 138 is shaped so as to lie in a cylindrical plane (not illustrated). This opening 138 is substantially rectangular. The base 134 of the spout 114 is correspondingly modified so as to have a cylindrical shape such that when the spout 114 is assembled on the cap part 112 this base 134 will bear against the sealing surface 144 at all points along the length of this surface 144 in the manner indicated in the preceding so as to form a seal against leakage.

Preferably the washer spring 140 is of such shape and dimension as to maintain substantially equal pressure between the sealing surface 144 and the base 134 at all points along the length of the surface 144 in order to create an effective seal between the cap part 112 and the spout 114. This equal pressure can be achieved by minor variation in the physical shape of the washer spring 140 while maintaining a uniform wall thickness within this washer spring 140 or it can be achieved by minor variations in the wall thickness of this washer spring or by a combination of both of these expedients. It is not necessary that the forces between all portions of the sealing surface 144 and the base 134 be precisely uniform so long as the forces at all points along the length of the sealing surface 144 exerted against the base 134 are adequate to maintain a constant seal.

The particular washer spring 40 illustrated is essentially shaped as a frustrum of a right circular cone. Such a cone is substantially of a concavo-convex configuration. A spring of such a configuration is sometimes referred to as a Belleville spring. Various closely related washer springs such as those having a curved concavo-convex configuration may be substituted for the precise washer spring 40 illustrated since all of such springs are capable of exerting a continuous upwardly biasing force which will maintain a seal against the base 34 of the spout 14 at all times when there is contact between a sealing surface 44 and the base 34. Further, all such springs are capable of maintaining substantially uniform sealing pressures along the length of a sealing surface such as the surface 44.

In effect, the washer spring 40 is an integral part of the cap 12 which serves to maintain a constant or substantially constant biasing force forming a seal against the base 34 of the spout 14. Such an action is considered to be inherently different from the action achieved by merely locating a somewhat flexible, deformable sealing ring on an inflexible or relatively inflexible portion of a cap so that the sealing ring flexes or deforms and may or may not cause a minor amount of deformation of a relatively inflexible portion of the cap supporting such a sealing ring.

I claim:

1. A dispensing closure having a cap provided with an opening leading through said cap between the interior and the exterior of said cap, sealing means for forming a seal with a spout located on the exterior of said cap around and adjacent to said opening and mounting means for holding a spout so that it can be moved relative to said cap, said dispensing closure also having a spout provided with a base and a passage extending through said spout from said base, said spout being held by said mounting means so as to be movable from a closed position in which said sealing means engages said base so as to seal off said opening and an open position in which said opening is aligned with said passage and in which said sealing means engages said base around said passage in which the improvement comprises:

said cap including a resilient spring-like member supporting said sealing means and extending outwardly therefrom so as to have a periphery spaced from said sealing means, said periphery being attached to and supported by the remainder of said cap, said spring-like member holding said sealing means resiliently against said base of said spout at all times during the movement of said spout between said open and closed positions and when said spout is in said positions, said sealing means comprises a surface located on said spring-like member which is held by said spring-like member so as to resiliently engage said base on said spout, said cap, said spring-like member and said sealing means are integral with one another and are formed of a polymer material selected from the group of polymers consisting of injection moldable polyolefin polymers and polymers having the physical properties of injection moldable polyolefin polymers, said periphery of said spring-like member is attached to and supported by the remainder of said cap so as to be substantially immobile.

2. A dispensing closure as claimed in claim 1 wherein:

said spring-like member is of concavo-convex configuration.

3. A dispensing closure as claimed in claim 1 wherein:

said spring-like member holding said sealing means so that substantially equal pressure is applied to said base completely along the length of said sealing means.

4. A dispensing closure as claimed in claim 1 wherein:

said spring-like member is of concavo-convex configuration and said spring-like member holding said sealing means so that substantially equal pressure is applied to said base completely along the length of said sealing means.

5. A dispensing closure as claimed in claims 1 or 4 wherein:

said base has a spherical external configuration, and said sealing means extends in a flat plane around said opening.

6. A dispensing closure as claimed in claims 1 or 4 wherein:

said base has a cylindrical external configuration, and said sealing means extends in a cylindrical plane around said opening and conforms in shape to the shape of said base.

* * * * *